United States Patent [19]

Debenham et al.

[11] 4,105,134

[45] Aug. 8, 1978

[54] PRESSURE RELEASE CLOSURES

[75] Inventors: Michael Debenham, Frankston; Allan George Dalli, Warrandyte; Peter Louis Revell, Middle Park, all of Australia

[73] Assignee: The Broken Hill Proprietary Company Limited, Melbourne, Australia

[21] Appl. No.: 839,213

[22] Filed: Oct. 4, 1977

[30] Foreign Application Priority Data

Jun. 10, 1977 [AU] Australia ..... 0416/77
Jul. 14, 1977 [AU] Australia ..... 0848/77

[51] Int. Cl.[2] ..... B65D 41/32
[52] U.S. Cl. ..... 220/268; 220/271
[58] Field of Search ..... 220/268, 269, 271

[56] References Cited

U.S. PATENT DOCUMENTS 3,741,432 6/1973 Werth et al. ..... 220/268
3,972,445 8/1976 DeLenham ..... 220/268

FOREIGN PATENT DOCUMENTS 1,444,470 5/1974 United Kingdom ..... 220/268

*Primary Examiner*—George T. Hall
*Attorney, Agent, or Firm*—Murray & Whisenhunt

[57] ABSTRACT

A push-in pressure releasing resealable closure for an aperture in a sheet metal container member is disclosed, wherein the closure is integral through a connection of metal to the remainder of the container member. The closure is designed so that it is depressible into the container by flexing about the connection when push-in force is applied to the closure, without exceeding the elastic limit of the connection, so that the closure is returned at least substantially to its original position to seal the can contents, upon removal of the push-in force from the closure.

The closure is particularly suitable for use in containers for carbonated beverages, such as carbonated soft drinks and beer, so that the gas pressure within the container may be released without danger of substantial gushing or spurting, to permit a larger pouring opening in the container member to be opened.

8 Claims, 14 Drawing Figures

PRESSURE RELEASE CLOSURES

BACKGROUND OF THE INVENTION

This invention relates to improvements in easy opening closures, and more particularly to improvements in pressure releasing vent closures of the type presently used in can ends having push-in closures.

It is generally accepted in the can making art that a can having push-in closures requires, for highly carbonated beverages, some form of pressure releasing venting closure by means of which the pressure within the can may be at least reduced prior to opening the pouring closure. An example of a pressure releasing venting closure is shown in FIG. 1 of the accompanying drawings, in which it will be noted that the venting closure V is smaller in area than the pouring closure P.

Cans containing highly carbonated beverages, including those having venting closures as shown in FIG. 1, are liable to gush or spurt on being opened, especially where the beverage in the can tends to froth. The problem is aggravated when the can is tilted during the opening operation since this often means that the liquid in the can is close to or covers the venting closure whereby the escaping gas is more likely to entrain some of the liquid or froth in the can. The problem is even more aggravated where the can is roughly handled prior to the opening thereof since agitation causes the release of carbon dioxide into the can head space, thereby generating froth.

U.S. Pat. No. 2,261,117 to Jack, Jr., discloses a push-in closure comprising a single closure member. The closure member is formed by forming a bulge in the container member, severing around the bulge to form a severed bulged tab, and then flattening the bulged tab to place the cut edges thereof and the marginal portions surrounding the opening in overlapping relationship.

U.S. Pat. No. 3,334,775 to Klein et al discloses a gated can lid wherein the gate is depressible into the container by digitally applied push-in force. The container has a single gate therein, but the patentees describe, at column 4, lines 62 – 66, an arrangement wherein a portion of the gate panel might be folded inwardly from each end to provide a specific pouring portion and a venting portion, with the section of the gate panel between these portions remaining in position. Klein et al do not disclose or suggest a resealable venting member.

U.S. Pat. 3,741,432 to Werth et al and Australian Pat. No. 475,951 each disclose a closure tab for a container, with a pressure release tab formed in the closure tab. Manual pressure applied to the pressure release vent tab is transferred to the closure tab. Both the release vent tab and the closure tab are depressible by the pressure of the user's thumb applied to the release vent closure tab and transmitted to the closure tab in a single operation which first exposes the release vent and then the closure vent or opening. Werth et al have no suggestion that the pressure release vent tab disclosed therein is resealable upon the release of digitally applied push-in force. As a matter of fact, the entire thrust of the Werth et al patent is to permit the pressure to be vented and the pouring opening to be opened in one operation without withdrawing a digit from the tab area.

U.S. Pat. Nos. 3,759,206 (Re. 28,910) and 3,931,909 are directed to push-in, easy opening closures for containers such as metal beverage cans. The patents disclose forming the easy opening closures by bulging an area of a can end, or other container member, and cutting a tab from the container member, with at least a portion of the bulge lying outside of and surrounding the tab. After the severing or cutting operation, the bulge surrounding the opening is flattened to displace the metal into overlapping relationship with the cut edges of the tab.

U.S. Pat. No. 3,958,717 to Ellis discloses a push-in, easy opening closure which includes a pouring tab and a vent tab. The tabs are integrally connected to the can lid by a hinge area, and share a common hinge area, with the tabs extending in opposite direction from the common hinge area. The patentees indicate that this construction results in an appearance similar to a conventional ring-pull end, so special instructions would not be required to educate the consumer, and also with the tabs located immediately adjacent to each other the can can be opened with a minimum of finger movement. There is no suggestion that the vent tab reseals itself upon the removal of finger pressure applied thereto.

U.S. Pat. No. 4,033,275 to Radtke discloses a beverage can end having a vent tab and a pour tab, generally similar to the design of U.S. Pat. No. 3,958,717, except the tabs do not share a common hinge area, but instead are disclosed as remote from one another.

It is thus an object of the present invention to provide improved forms of pressure releasing closure by means of which the gushing or spurting problem described above is at least alleviated or made more controllable.

SUMMARY OF THE INVENTION

The present invention provides a push-in pressure releasing closure in a container member, comprising a closure member formed integrally from a portion of the container member and capable of being opened by a push-in force, said closure member having an operating portion which is adapted in use to have said push-in force applied thereto, and a connection to said container member about which said closure member flexes during the opening operation, said closure member being constructed to return to its closed position in the absence of said push-in force.

It will be appreciated from the above that since the closure member does not remain open except when the push-in force is applied to the operating portion, gushing or spurting will not be allowed to continue when the force is removed. Furthermore, since the push-in force must be applied to keep the closure member open, the finger or thumb applying the force will act to deflect any liquid or gas coming from the closure.

In the case of the prior art arrangement shown in FIG. 1, the tendency is for the person opening the closure to have removed his finger from the closure before spurting commences, leaving, in the extreme situation, the spurting liquid free to create a fountain.

DETAILED DESCRIPTION OF THE INVENTION

The improved pressure releasing closure may be achieved in several ways. For example, the extent to which the operating portion is raised and/or the effective area of the pressure releasing closure member available for actuation may be selected so as to prevent deflection by a digitally applied force beyond the angle at which the elastic limit of the metal at said connection is exceeded, thereby preventing permanent opening of the closure member by finger or thumb pressure. Alternatively, the connection may be arranged at a remote position relative to the operating portion compared to the prior art arrangement, in which the hinge is right at the periphery of the operating portion, and the closure member cannot be opened sufficiently to deform beyond its elastic limit the metal defining the connection.

In one particularly preferred form of the invention, the pressure releasing closure is formed at the narrow end of a generally pear shaped pouring closure hinged to the end about its wide end, said pressure releasing closure being partly severed from said pouring closure except for a narrow connection about which the pressure releasing closure flexes during the pressure releasing opening thereof, said pressure releasing closure preferably being raised to such an extent or being of an effective size such as to prevent permanent opening thereof by finger or thumb pressure.

In the case of the arrangement shown in FIG. 1, the thumb or finger is likely to cover the hole formed on opening the venting closure. This has been found to result in undesirable opening characteristics being introduced by the user since the tendency is for the user to remove the thumb or finger as soon as gas escape is detected. With the preferred arrangement described above, the escape of gas can occur as soon as the closure is opened while the escape of spurting liquid can be prevented by releasing the opening force on the closure member, and controlled escape achieved by releasing the gas and/or froth in short bursts.

In another preferred form of the invention, the pressure releasing closure member is formed as an extension on a pouring closure, with the openings being closed by the respective closures preferably being interconnected to form a single opening. In this arrangement, the pressure releasing closure operates in the manner described above but is removed from its opening when the pouring closure is opened thus providing a venting opening by means of which the contents of the can may be vented during the pouring operation.

In another preferred embodiment of the present invention, the operating portion is located at one end of a relatively narrow elongated portion extending from the connection to the container member. With this arrangement it is unlikely that the finger or thumb applying the opening force will completely cover the whole of the closure thus leaving an escape path for the gases being released from the container.

For all of the embodiments of the present invention, it is critical that the closure not be depressed into the opening with which the closure is associated to an extent as to exceed the elastic limit thereof. By causing the closure to depress into the beverage can or other container upon the application of digitally applied push-in force thereto, with flexing of the closure about the connection, without exceeding the elastic limit of the connection, the closure will be returned at least substantially to its original position, thereby to reseal the container against further escape of froth or liquid therefrom. The internal pressure within the container aids in the resealing of the closure.

The exact amount of depression which a given closure can experience without the elastic limit of the connection thereof being exceeded will depend upon a number of variables, such as the size of the closure, the thickness of the metal, the type of the metal, the effective length of the connection, and the like. Generally, it is not possible to specify an exact amount of closure deflection which can be encountered before the elastic limit of the connection is exceeded. However, in general terms the amount of angular depression of the closure may be more readily appreciated from consideration of the following simulated test.

A closure was formed in a sheet of 5082 Aluminum, having a thickness of 0.015 inches. The closure was of the design set forth in FIG. 6, with the central cut being located 0.016 inches from the center of the closure. The free or cut edges of the sides of the closure were located approximately 0.015 inches from the center of the closure. The end of the closure furtherest removed from the connection was deflected into the simulated can a distance of 0.030 inches, corresponding to an angular deflection of 5.5°, and upon removal of the deflecting pressure the closure returned to approximately its original position. A deflection of 0.035 inches still resulted in the return of the closure to approximately its original position - that is, the elastic limit of the connection was not exceeded. However, upon depressing the closure a distance of 0.040 inches corresponding to an angular deflection of 7.5°, permanent deformation of the connection occurred, and the closure would not return to its original position.

This simulated test was conducted by clamping the closure at the hinge line, with the application of force applied to the free edge of the closure which was furtherest removed from the hinge line.

Based on the results of this test, it appears that the angular displacement of the closure must be less than 7.5°, and preferably no more than 5.5° to 6.0°. Of course, the depression must be sufficient to permit the escape of pressure from the container interior, and the minimum deflection which will accomplish this result will depend upon a number of variables, including the thickness and type of the sealant applied to the line of severance.

In actual use by consumers, whose opening habits may vary widely, it may be possible to occasionally obtain some slight permanent deformation of the connection or hinge, but this deformation would be unusual (perhaps caused by excessively strong consumer) and should be minimized by the internal pressure of the can, especially when carbonated or malt beverages are contained therein.

In order that the invention may be more readily understood, several preferred embodiments of the invention will now be described with reference to the accompanying drawings in which.

Figure 1:
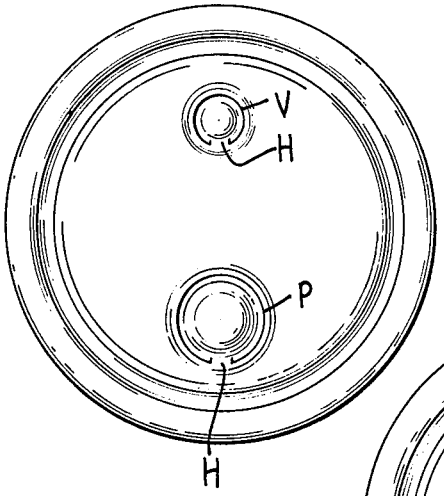
FIG. 1 is a plan view of a can end according to the prior art.

Referring firstly to FIG. 1 of the drawings, the prior art can end shown in FIG. 1 has a pressure releasing/-venting closure V and a pouring closure P. Each closure is circular and is integrally hinged at H to the can end at the periphery of the closures. Thus when the closures V and P are opened, they hinge about H and since the opening force deflects the closures to such an angle that the elastic limit of the metal forming hinge H is exceeded the closures will remain open once opened. In the case of closure V, the tab thereof is raised more than the pouring tab to ensure that it can be pushed open to such an extent as to permit adequate venting of the can during pouring.

Figure 2:
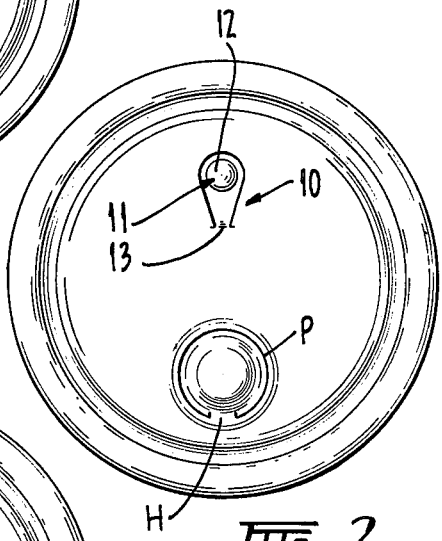
FIG. 2 is a plan view of a simple embodiment which demonstrates the principle of operation thereof in comparison with the prior art end.

In the simple or schematic embodiment of the invention shown in FIG. 2, the venting closure V is replaced by a pressure releasing closure 10. The closure 10 comprises a closure member or tab 11 having an operating portion 12 in the form of an upwardly raised button by means of which an opening force can be applied to the closure 10 by a finger or thumb. The tab 11 has a relatively elongate narrow configuration compared to the venting closure V and is integrally connected to the end at 13. The connection 13 does not act as a hinge in use in the same manner as hinges H in FIG. 1 operate, and for this reason the connection is described as a connection rather than a hinge.

The closure member 11 is of the fully sheared construction described in U.S. Pat. Nos. Re. 28,910 (3,759,206) and 3,931,909, the disclosures of which are hereby incorporated by reference, and is formed by the method disclosed therein, or by coining or otherwise expanding the tab and/or by contracting the size of the opening by means of any suitable cold working operation such as coining.

During opening, a force is applied to the raised portion 12 by means of a finger or thumb. Since the connection 13 is remote from the portion 12, it is unlikely that the whole of the closure will be covered by the finger and gas escape openings will be exposed at least along the long sides of the tab 11. Furthermore, the remote positioning of the connection 13 means that the angle to which the tab 11 can be deflected by a digitally applied force will not be so great as to exceed the elastic limit of the metal at the connection 13 so the tab will resume at least substantially its closed position on removal of the opening force. This will of course be assisted by any pressure within the can or by escaping contents. These two factors combined means that in the event that spurting does occur, it can be controlled by means of the closure 10 by removing the opening force and releasing the gas and/or froth in short bursts.

In practical embodiments the closure 10 is likely to be positioned closer to the centre of the can end to reduce the likelihood of liquid being present in the gas released from the can. Furthermore, it will be appreciated that in any commercial embodiment the closures 10 and P will be hermetically sealed by means of sealant (not shown), such as a plastisol, applied to the end in any suitable manner.

Notwithstanding the ability of the above embodiment to at least reduce the problems associated with the prior art, the arrangement does have one practical disadvantage in that the closure 10, upon the release of the push-in opening force, no longer acts to vent air into the can during the pouring or drinking of liquid therefrom. The problem can however be overcome by adopting any one of the closure configurations shown in FIGS. 3 to 12 of the drawings.

Figure 3:
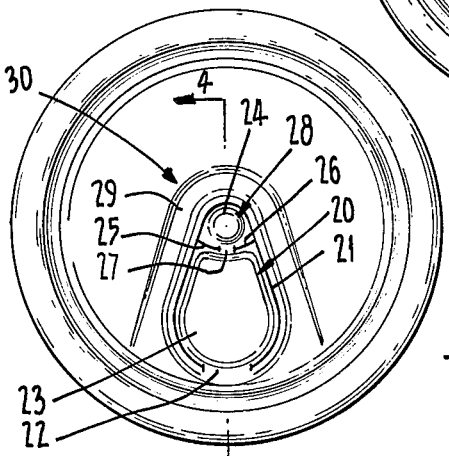
FIG. 3 is a plan view of one preferred practical realisation of the invention.
Figure 4:
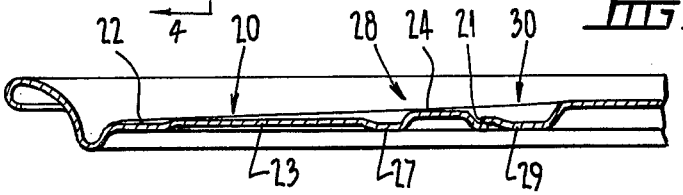
FIG. 4 is an enlarged fragmentary sectional elevation of the end of FIG. 3 taken along the line 4—4 in FIG. 3.

The can end shown in FIGS. 3 and 4 is formed with a fully sheared closure member surrounding a generally pear-shaped opening 21 and is hinged to the end at 22. The tab 20 is formed with a raised area 23 extending from the wide end of the tab 20 and a smaller raised area or button 24 adjacent the narrow end of the tab 20. The narrow end of the tab 20 is partly severed from the remainder of the tab 20 along lines 25 and 26 leaving a narrow connection 27 and thereby defining a pressure releasing tab 28. The button 24 in tab 28 is raised to a greater extent than the area 23 so as to be more readily accessible for finger or thumb actuation. For example the tab 28 may be raised by about 1 mm above the periphery of the tab 20 and it will be noted from the drawing that the tab 20 is level with the raised periphery of the opening 21.

The lines of severance 25, 26 allow the pressure releasing tab 28 to be flexed about connection 27 while the height of the tab 28 is selected to prevent permanent deflection after removal of the opening force applied by a finger or thumb. When the opening force is removed, the tab 28 will close to prevent continued spurting in the event that spurting occurs. Once the pressure in the can has been released, the closure 20 is easily opened by finger pressure applied to the raised area 23 of tab 20. As in the earlier embodiment, sealant (not shown) is applied to cover all lines of severance in the closure.

It is desirable, both to protect the tabs 20 and 28 against unintentional opening, and to stiffen the end against outward buckling under pressure, to form the closure within a depressed area 29 formed in the end. The depressed area 19 may be formed by slightly doming the end panel, say by about 1.5 mm, and then flattening the dome to form the area 29, Alternatively, a flat end panel may be formed with the depressed area 29. In this way the tabs 20 and 28 are protected by the upstanding portion 30 of the end panel and the panel is stiffened against outward buckling.

It will be appreciated from a consideration of the above description that the embodiment of FIG. 3 effectively combines the separate pressure releasing tab of FIG. 2 and a pouring tab, with the tab 20 itself defining the connection between the pressure releasing tab 28 and the can end. By effectively joining the pressure releasing opening and tab to the pouring opening and tab, the venting opening is opened when the tab 20 is opened thereby overcoming the problem created by the resealing nature of the pressure releasing tab 28. However, until the tab 20 is opened, the pressure releasing tab acts in the same manner as described above and therefore alleviates the problems associated with the prior art at least to the same extent as the first embodiment.

The configuration of the opening 21 results in acceptable pouring and drinking characteristics.

The closure is formed by a modified version of the method described in the patents referred to above. It is not practical under high speed end forming conditions to sever the tab 20 and to form the slits 25 and 26 at separate die stations.

Thus, according to another aspect of the present invention, there is provided a method of forming a closure tab having lines of severance extending generally transversely to the line of severance of the tab itself, including severing the metal along said transverse lines by means of stepped punch and a spring biased die member slidably located within the main die member for severing the tab said spring biased die member being pushed into the main die member as the main severing operation takes place.

In use the stepped punch initially severs the sheet metal said transverse lines and partly severs the adjacent portion of the tab. Then the slidable die member is pushed into the die whereupon the remainder of the tab is severed.

Figure 5:
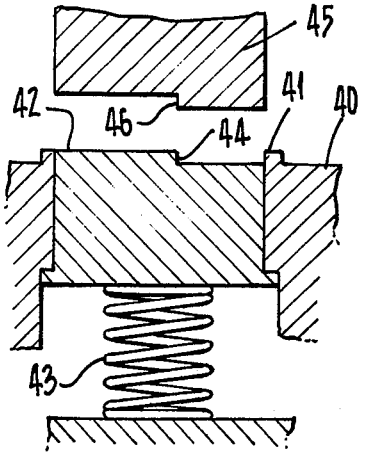
FIG. 5 is a schematic fragmentary sectional elevation of die components suitable for forming the closure shown in the FIGS. 3 and 4.

An apparatus suitable for forming the closure is shown schematically in FIG. 5 which is a fragmentary schematic sectional elevation of the die components. The die includes a main die member 40 having a cutting face 41 in the shape of the opening 21, and a die member 42 slidably mounted within the main die 40 and biased towards the position shown by means of a spring 43. The slidable member 42 is formed with two cutting faces 44, only one of which is shown, for forming the lines of severance 25, 26. A stepped punch 45 having cutting faces 46 corresponding to the cutting faces 44 is arranged to initially engage the slidable member 42 to sever along the lines 25 and 26 and to sever the perimeter of the pressure releasing tab 28. The punch 45 then pushes the slidable member 42 into the die 40 whereupon the punch 45 severs the remainder of the tab 20 from the end.

The sheet metal displaced by severing along the lines 25, 26 is returned to the same plane as the remaining metal to ensure that the periphery of the tab is substantially planar. If necessary the metal on either side of each line of severance may be coined to ensure that the slits do not open up.

If necessary the edge of the tab 20 and/or the periphery of the opening 21 may be coined or otherwise worked to increase the overlap between the tab 20 and the surrounding metal.

Figure 6:
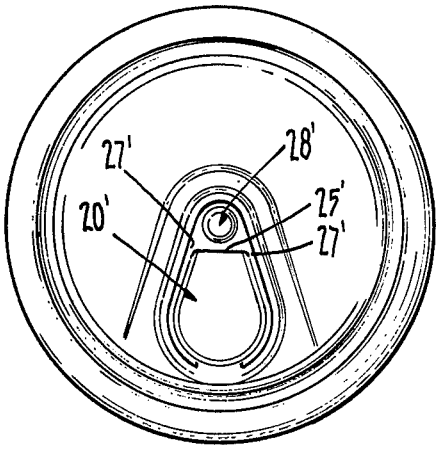
FIG. 6 is a plan view of a modified form of the embodiment of FIG. 3.

A modification of the closure of FIGS. 3 and 4 is shown in FIG. 6. In this modification, the lines of severance 25, 26 are replaced by a central line of severance 25' leaving two spaced connections 27' between the pressure releasing tab 28' and the main tab 20'. The closure is otherwise identical to the embodiment of FIGS. 3 and 4 and operates in exactly the same manner. However, it has the advantages of having an unsevered periphery and being more resistant to leakage than the embodiment of FIG. 3, wherein leakage may occur if the lines of severance 25, 26 are displaced. Furthermore, the unsevered periphery of the closure of FIG. 6 results in a less complex die operation in the closure fabrication. In this instance, the central line of severance may be formed by a so-called "offset shear" die operation.

The closure of FIG. 6 is formed in the following manner. The end panel is outwardly domed by about 1.5 mm by a die operation or by coining around the periphery of the end panel adjacent the countersink. The area in which the closure is formed is flattened and the sheet metal raised in the region in which the pressure releasing tab 28' is to be formed. The tab 20' is then severed and the initial bulging operation described in the above patents is performed. At the same time, the tab 20' is raised by a form punch and the metal locally sheared along line 31 around an edge of the form punch. The bulged metal around the opening is then flattened to form an overlap between the tab and surrounding metal and sealant is applied along all lines of severance.

If necessary, the metal on either side of line 31 may be coined to ensure that the line does not open. Alternatively, the form punch may be notched so that the line 31 is interrupted over a short distance. Of course, instead of shearing along line 31, a line of weakness, such as a score line, may perform the same function. Once again the periphery of the tab and/or the metal surrounding the opening may be coined to increase the overlap between the tab and the surrounding metal.

Figure 7:
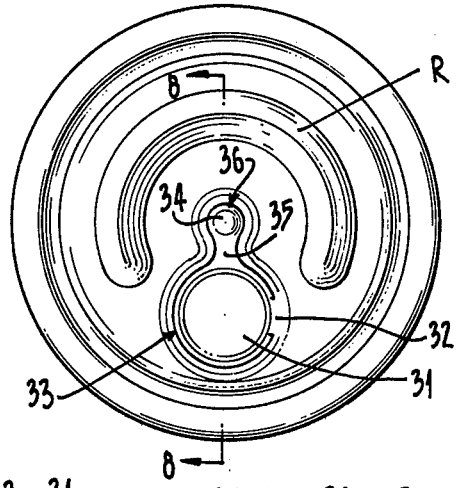
FIG. 7 is a plan view of another preferred realisation of the invention.
Figure 8:
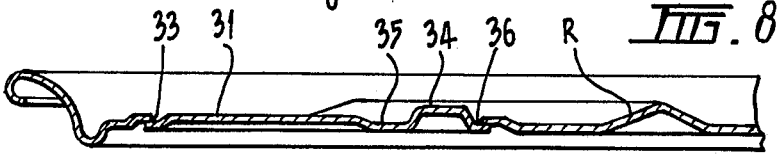
FIG. 8 is an enlarged fragmentary sectional elevation taken along the line 8—8 in FIG. 7.

The can end shown in FIGS. 7 and 8 is formed with a fully sheared closure comprising a pouring closure member or tab 31 hinged to the end at 32 and underlying a pouring opening 33, and a pressure releasing venting closure member or tab 34 secured to the pouring tab by means of an integral neck 35 and extending radially therefrom to underlie a venting opening 36 which opens into the pouring opening 33 over the neck 35. The tabs 31 and 34 are upwardly raised with the tab 34 being raised to a greater extent so as to be more readily accessible to finger or thumb. For example the tab 34 may be raised by about 1 mm above the periphery of the tab and it will be noted from the drawing that the tab 31 is level with the raised periphery of the opening 33.

The closure described above is formed by the same method as the closure 10. If necessary the edge of each tab 31 and 34 and/or the periphery of each opening 33 and 36 may be coined or otherwise worked to increase the overlap between the tabs and the surrounding metal.

The embodiment of FIGS. 7 and 8 effectively combines the separate pressure releasing tab of FIG. 7 and a known pouring tab, with the tab 31 defining the connection between the pressure releasing tab 34 and the can end. In use, the venting opening 36 is opened when the pouring tab 31 is depressed thereby overcoming the problem created by the resealing nature of the pressure releasing tab 34. However, until the pouring tab 31 is depressed, the pressure releasing tab acts in the same manner as described above and therefore alleviates the problems associated with the prior art at least to the same extent as the first embodiment.

To both protect the tab 34 against unintentional opening and to stiffen the end against outward buckling under pressure a raised rib R is formed in the end, for example in the form shown in FIGS. 7 and 8. The configuration and placement of the rib in the manner shown in the drawings is not essential to the invention since many other configurations and positionings of one or more ribs or beads are envisaged as being just as effective for the purposes described. It will also be appreciated that similar protective rib(s) may be incorporated into the arrangement shown in FIG. 2 of the drawings.

The positioning of the hinge 32 as shown in FIG. 7 is also not essential or even necessarily most preferred. The hinge may be located at the position shown in FIG. 3 of the drawings or directly opposite the position shown in FIG. 7.

Similarly the particular configuration of the combined openings 33 and 36 is not essential to the invention. The smoothly rounded nature of the opening over the neck 35 is preferred for aesthetic and practical reasons and it is believed that the configuration shown would provide good drinking and pouring performances.

Figure 9:
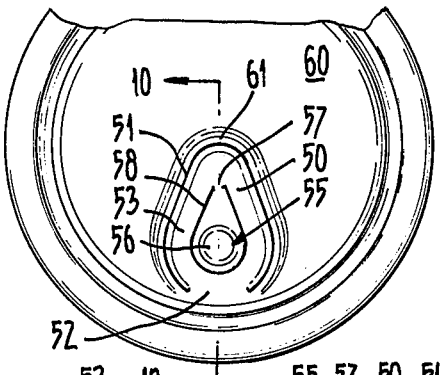
FIG. 9 is a plan view of yet another form of the invention.
Figure 10:
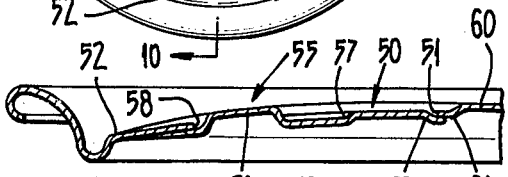
FIG. 10 is an enlarged sectional elevation along the line 10 — 10 in FIG. 9.
Figure 11:
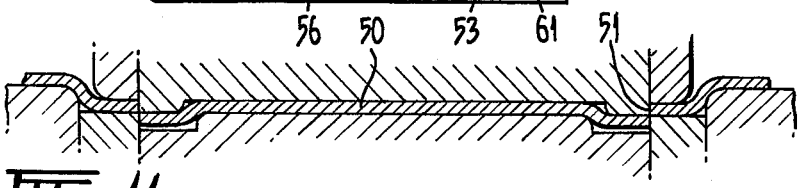
FIG. 11 is a schematic representation of one of the stages in the formation of the closure of FIGS. 9 and 10.

The can end shown in FIGS. 9 and 10 of the drawings has a fully sheared closure member or tab 50 which overlaps with and underlies the metal surrounding a generally pear shaped opening 51 and is hinged to the end at 52. The tab 50 has a central area 53 which is raised with respect to the periphery of the tab. However, it will be noted that the raised area 53 is at the same general level as the sheet metal defining the hinge 52 whereby the hinge metal is substantially undeformed by the closure forming process which will be defined in more detail below. Tests carried out to date appear to suggest that the undisturbed nature of the metal at the hinge 52 may well increase the pressure at which peaking or buckling of the end will occur in this general area of the end.

The tab 50 has a pressure releasing closure member or tab 55 formed therein in the manner shown in FIGS. 9 and 10 of the drawings. The tab 55 is formed with an upwardly raised button 56 at the end of a relatively elongate narrow area of metal defining the tab. The tab is hinged to the sheet metal defining the tab 50 at 57 and overlaps with and underlies the sheet metal surrounding the sheared opening 58. Both closures are hermetically sealed by means of a sealant (not shown) and the pressure releasing closure operates in the same manner as the pressure releasing closures described in the earlier applications referred to above. However, it will be appreciated that most opening operations the two closures will be opened by means of a single unidirectional push-in force applied in the general area of the raised button 56 on the pressure releasing tab 55. Of course, in the situations described in the earlier applications it may be necessary to actuate the pressure releasing closure several times. However, it should not be necessary for the user to relocate his or her digit for the final opening operation in which the tab 50 is fully opened. If desired the tab 55 may be located in an inverted position adjacent the narrow end of tab 50 to ensure that relocation of the digit is not required during the opening of tab 50.

The above embodiment of the invention is similar in construction to the closure described in U.S. Pat. No. 3,741,432 Werth et al with the exception that the pressure releasing tab 55 is formed in accordance with the present invention rather than in the manner shown in the U.S. Pat. Thus, the closure shown in FIGS. 9 and 10 will have the same advantages over the Werth et al closure as the previous embodiments have over the prior art shown in FIG. 1. Furthermore, the use of a common hinge area, as shown in FIGS. 1 and 3 of the Werth et al patent, may have disadvantages in that the depression of the pouring tab 15 causes further depression of tab 21 thereby increaisng the likelihood of the hinge fracturing to detach the tab 21 from the can end.

It will be noted from FIGS. 9 and 10 of the drawings that the can end incorporating the improved closure has an outwardly domed central panel 60. Although it is not readily apparent from the drawing, the dome is slightly flat topped for a reason to be described below. The closures 50 and 55 are formed in a downwardly depressed area 61 which extends into the domed end from the hinge area 52 in the same general configuration as the tab 50. The location of the closures 50 and 55 within the depressed area 61 protects the closure 50 against unintentional actuation and to a lesser extent the closure 55 is similarly protected against unintentional actuation.

The slight flattening of the dome formed in the end panel 60 increases the height of the dome in the region in which the pressure releasing tab 55 is to be formed thereby increasing the amount of protection afforded to the tab 55 by the adjacent areas of the end panel 60.

It will be noted from the sectional elevation of FIG. 10 that the top of the button 56 is located at the same general level as the surrounding sheet metal of the central panel.

The end panel 60 is also preferably domed for the following reasons. The doming of the end panel increases the head space of a can to which the end is fitted. The doming of the end panel also increases the rigidity of the end panel. Finally, it is believed that the doming of the end panel will usefully enhance the buckle strength of the converted end. In tests carried out on plain ends it was found that the doming of the end panel between about 1.5 mm and about 3.0 mm increased the buckle strength of the end. Improvement in the buckle strength increased as doming increased.

One preferred method of forming the improved closure will now be described. In a first operation the end panel is formed with a slightly flat topped dome. In a second operation the dome is downwardly depressed to form the area 61 and to form a small dimple in the region in which the button 56 is to be formed. The dimple is then reformed into the flat topped button 56 by flattening the top of the dimple between two die members. In a fourth operation the tabs 50 and 55 are sheared and in the same operation the periphery of the tab 50 is reformed downwardly to form the upwardly raised area 53. This operation is shown schematically in FIG. 11 which is a fragmentary sectional view across the tab 50 but including the tab 55. As mentioned above, the central portion of the tab remains at the same general level as the unsheared metal defining the hinge 52. In a fifth stage the height of the shoulder of metal defined by the sheared portion of the sides of the area 61 is reduced and the angle of the side to the end panel increased to produce some overlap between sheet metal surrounding the opening and the tab 50. Finally, the periphery of the tab is coined to increase the area of the tab and further increase the overlap between the tab and the sheet metal surrounding the opening. The sheet metal surrounding the opening 58 is also coined to produce overlap between the opening and the pressure releasing tab 55. The coining of the periphery of the tab 50 is preferably performed at a position close to the shoulder of the raised area 53 so that most of the metal expansion is in the outward direction rather than back towards the centre of the tab. To avoid excessive curling of the periphery of the tab during this operation, the edge of the tab is firmly clinched by die members. Each of the above operations will be well known to persons skilled in the art and are therefore not shown in detail in the drawings.

It will be appreciated that in the above description some of the formation stages have been artificially separated for purposes of clarity. In any practical conversion of the can end certain of the stages may be combined within a single die operation or separated from the stages described above. For example, the formation of the dimple may need to be performed in a separate stage.

The above method of forming the improved closure is preferred for several reasons. Firstly, formation of the closure within the downwardly depressed area 61 in the domed central panel provides protection against unintentional opening of the closure. Secondly, the downward reforming of the periphery of the tab 50 enables its central portion to remain at the same level as the hinge 52 and it is believed that this may well improve the pressure performance of the converted end. This method of forming the tab 50 also enables the pressure releasing tab 55 to be sheared from the tab 50 in the same die operation without any undesirable deformation of the tab 50. To form the same type of closure combination in a flat or upwardly raised area of metal, the shearing of the tabs may result in downward turning of the edges of the larger tab which may need to be flattened or restored in a subsequent die operation.

While the above described method of formation is preferred, it will be appreciated that other methods of formation may well be used with equally acceptable results. For example, the sheet metal surrounding the opening 51 may be coined to increase the overlap between the tab 50 and the surround. Alternatively, the overlap between the tab 50 and the surround may be produced solely by suitably reforming the shoulder referred to above. The overlap between the pressure releasing closure 55 and the surrounding sheet metal is preferably formed as described above since this enables the button 56 to be made larger and to be located closer to the periphery of the opening 58. However, the necessary overlap may be produced by coining the periphery of the tab 55.

In the light of the above description of the modified closure, a still further aspect of the present invention includes an easy opening closure member formed in a container member, the improvement comprising said closure member being formed within a downwardly depressed area within the sheet metal defining the container member, said closure member having a peripheral portion which extends downwardly and outwardly from the remainder of the closure member into overlapping and underlying relationship with the sheet metal surrounding the opening closed by the closure member.

Preferably the sheet metal defining the remainder of said closure member is located at about the same level as the sheet metal defining a hinge portion between said closure member and said container member whereby said hinge metal remains relatively undisturbed.

The invention also envisages a method of forming the closure member defined above, said method being characterised by shearing said closure member from said container member and during the shearing operation downwardly reforming the periphery of said closure member whereby the main part of the closure member remains at substantially the same level during the formation of the closure member.

It will be appreciated that the various closure members described in the earlier embodiments may be formed in substantially the same manner as the modified closure described in the above embodiment. For example, in the embodiments of FIGS. 3 and 6, the size of the depressed areas may be reduced to the same size as the area 61 and the upstand surrounding the opening may be flattened as shown in FIG. 10. In the case of the embodiments of FIGS. 7 and 8, the location of the closure within a depressed area would remove the need to form the protective ribs R.

Figure 12:
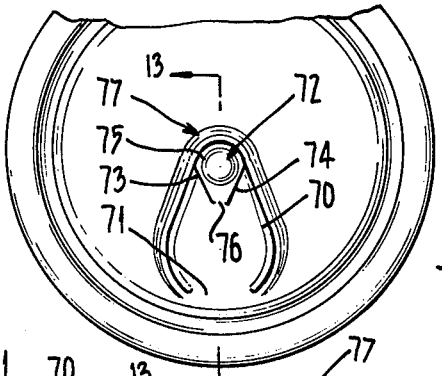
FIG. 12 is a plan view of a still further preferred realisation of the invention.
Figure 13:
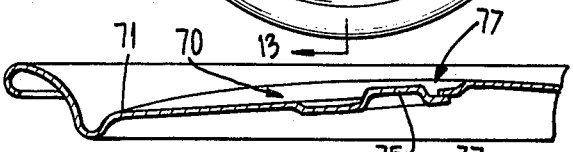
FIG. 13 is a sectional elevation taken along the line 13 — 13 in FIG. 12.

The embodiment of the invention shown in FIGS. 12 and 13 is a modification of the embodiment of FIGS. 3 and 4 and includes a fully sheared closure member or tab 70, similar to the tab 20 of FIG. 3, hinged to the end at 71. The tab 70 has a pressure releasing closure member or tab 72 defined by lines of severance 73 and 74 extending to either side of a raised button 75. The lines 73 and 74 have an included angle of about 60° although it has been found that the tab 72 will operate successfully with the lines 73 and 74 at any included angle within the range of about 30° to 180°, and most successfully between 50° and 70°.

The tab 72 flexes about its connection 76 to the tab 70 in the same basic manner as the embodiment of FIGS. 3 and 4 although it will be noted that the angular nature of the lines of severance 73 and 74 positions the connection 76 more remotely from the raised button 75 than in the case of the embodiment of FIGS. 3 and 4.

For the tab dimensions and button height shown in the drawings, the tab 72 is incapable, in normal operation, of being opened by means of a digitally applied force beyond about 3° to 5°. This angle range is below the angle at which the metal at the connection 76 will be permanently deformed so that the tab 72 will in normal use always return to a substantially closed position once the opening force is removed.

The tab 70 is formed within a depressed area 77 which is formed in the same basic manner as described above in relation to FIGS. 9 to 11. However, the method of formation of the pressure releasing tab 72 is modified to form the lines of severance 73 and 74. The lines of severance 73 and 74 are formed by a stepped punch during an initial stage in the shearing of the tab 70. In the same initial operation, the remainder of the tab 72 is also sheared and as the punch progresses downwardly, the sides of the tab 70 are reformed downwardly and the tab 70 severed as described in connection with FIG. 11. The free edges of the two tabs 70 and 72 are then brought together so that the two tabs are coplanar at the periphery of the tab. The formation of the lines of severance and the downwardly reformed nature of the sides of the tab 70 leaves a step of one material thickness between the tabs 70 and 72 along the inner portions of the lines of severance 73 and 74 (see FIG. 14).

The tabs 70 and 72 are coined near their free edges to increase the overlap between them and the surrounding metal. The coin is preferably interrupted at the lines of severance 73 and 74 to ensure free opening thereof during the flexing of the tab 72 about the connection 76.

Figure 14:
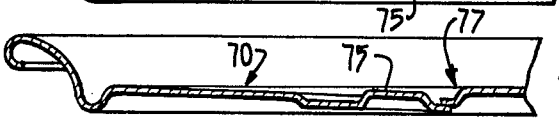
FIG. 14 is a fragmentary sectional elevation of the closure of FIGS. 12 and 13 formed in a depressed area in a flat end panel.

If desired, the depressed area 77 may be formed in a flat end panel, as shown in the sectional view of FIG. 14, to achieve the same degree of protection without doming the end panel. Similarly, the closure construction shown in FIGS. 3 and 4 may be formed by the above method rather than the method described in connection with this embodiment or vice versa. However, the avoidance of moving punch components is preferred.

It will be appreciated that the positioning of the pressure releasing opening and tab radially inwardly of the pouring opening and tab, at or near the centre of the end, as shown in FIGS. 3, 6, 7 and 12, offers the advantage that the pressure releasing tab is located at the best possible position to reduce the likelihood of the level of the liquid being above pressure releasing closure.

It will also be noted that in each of the above embodiments, the pressure releasing tab and opening is considerably smaller than the venting tab of the prior art ends and this results in the tab being significantly easier to open than the prior art tabs. The tab V in the prior art end must operate both as a pressure venting tab and an air venting opening and for this reason the tab must either be large enough and/or be raised to such an extent as to be capable of being permanently opened sufficiently to perform the second function. It will be understood that if the tab is small it must be raised further to allow access and if the tab is too small then there will be insufficient metal available to raise it to the extent necessary. However, since the tab in the present invention functions only to release pressure, it is not necessary or desirable to raise it enough to be manually depressed to a position in which it vents the can during pouring since this is achieved, in the second and third embodiments, when the pouring tab is opened. It should be appreciated however that the pressure releasing tab need not be smaller than the tab V in order for the advantages of the invention to be attained.

The configuration of the openings shown in FIGS. 3, 6, 7, & 12 is not essential and may be modified without affecting the performance of the closure as described above. It is envisaged that the sides of the pear-shaped opening 21 may be slightly curved outwardly to give the opening a more appealing appearance. Similarly the pressure releasing tab 28 may be used in place of the tab 11 shown in FIG. 2 or may be formed in a closure of any other suitable configuration.

While each of the above embodiments includes fully sheared tabs, the invention is equally applicable to closures defined by score lines or other forms of weakening lines, such as disclosed in U.S. Pat. No. 3,334,775.

The closures of the present invention can be used in can ends or in other container members, and can be formed of any suitable sheet metal material, including aluminum and steel, and can be of any suitable shape, depending upon the shape of the can body to which the can end or other container member is to be secured. It is also envisaged that the closures may be made in plastics materials by suitable moulding techniques.

There is no criticality in the absolute size of the pouring closure, although normally the pouring closure will be of such size as to prevent complete insertion of a user's finger, yet large enough to permit adequate outflow of liquid container contents. Likewise, the absolute size of the pressure releasing/venting aperture or opening is not critical, but normally the opening will be of a size as to prevent complete insertion of a user's finger, yet large enough to permit adequate outflow of internal container pressure upon pressure releasing, and to permit adequate inflow of air upon venting.

The sealant which is used for fully severed closures can be any suitable means or material, such as a sealing compound, plastic tape, adhesive foil, hot melt material, a combination thereof, etc. A particularly suitable sealing compound is a plastisol-grade polyvinylchoride combined with a conventinal plastisizer and compounding ingredients. Such plastisol should be heat curable to form a non-tacky, somewhat yieldable solid material that aids in retaining the closure in place and maintains a hermetic seal under pressures of the magnitudes which normally occur in cans of carbonated and malt beverages. The sealant must be sufficiently frangible to be ruptured upon the application of digitally applied push-in force on the respective closures. The maximum angular displacements of the closure mentioned above apply only to the indicated grade of aluminum, and to the indicated thickness thereof. Changes of these and other variables in the closure construction will change the maximum permissbile angle of displacement.

What is claimed:

1. A sheet metal container member comprising a generally planar area of the container member, an aperture in said planar area, a push-in, pressure releasing, resealable closure integrally connected to said planar area, said aperture being closeable by said closure, said closure being integral through a connection to said planar area, said closure and said connection cooperating to permit said closure to depress into said container by flexing about said connection when push-in force is applied to said closure, said closure being generally adjacent the area immediately surrounding said aperture and being larger in diameter than said aperture to provide an area of said closure and the area immediately surrounding the aperture in sealing overlapping relationship prior to the application of said push-in force, and said connection, said closure and said planar area further cooperating to substantially prevent permanent opening of said closure by a digitally applied push-in force to cause said closure to at least substantially return to said sealing overlapping position upon the removal of said push-in force from said closure.

2. Container member of claim 1, wherein said sheet metal container member also includes a second, pouring aperture and a closure therefor.

3. Container member of claim 2, wherein said pouring aperture closure is digitally depressable from a position generally adjacent the sheet metal surrounding said pouring aperture to a depressed position to open the pouring aperture, the said pouring aperture closure being integral through a hinge area to the sheet metal surrounding said pouring aperture.

4. A push-in, pressure-releasing, resealable closure in a sheet metal container member for use in a container suitable for containing carbonated beverages, comprising a free edge defining an opening in the sheet metal, a marginal portion located radially outwardly of said free edge, in integral closure member larger than said opening, said closure member severed from said container member around an at least substantial portion of the periphery of the closure member and lying under said marginal portion to prevent internal container pressure from displacing said closure member, and an integral connection between said closure member and the sheet metal from which said closure member was severed cooperating with said closure member and said marginal portion to permit said closure to depress into said container to release pressure therein by flexing about said connection when digital push-in force is applied to said closure and to physically limit the depression of said closure to cause said closure to at least substantially return to said position lying under said marginal area upon removal of said push-in force from said closure.

5. A sheet metal container member for use in a container suitable for containing carbonated or malt beverages, comprising:

a push-in, pressure-releasing, resealable integrally attached closure, a peripheral area of said sheet metal radially outwardly surrounding the closure, a first free edge of sheet metal lying radially inward of said peripheral area, proximate and generally following the inner perimeter of said peripheral area, throughout all but a minor part of said perimeter, in a female loop closed except in the area of said minor part, a second free edge of sheet metal lying within said peripheral area, proximate and generally following the inner periphery of said first free edge, in a male loop closed except in the area of said minor part, the second free edge laying laterally closer to the peripheral area than does the first free edge, excepting in minor length portions where said free edges adjoin said minor part, said first and second free edges lying in different planes, excepting in said minor part, so that when the container contains pressurized contents, the internal pressure tends to force the sheet metal bordering the male loop against the sheet metal bordering the female loop, said male loop, said peripheral area and said minor part cooperating to permit the sheet metal generally within said male loop to depress into the container away from the sheet metal bordering the female loop by flexing about said minor part when digital push-in force is applied thereto to release any pressure in said container, and further cooperating to substantially prevent permanent opening of said closure by a digitally applied push-in force to cause the sheet metal generally within said male loop to at least substantially return to a position adjoining the sheet metal bordering the female loop upon removal of said digital push-in force.

6. A sheet metal container member for use in a container for pressurized beverages, said container member including an area of said container member defining an aperture, a closure for said aperture for releasing pressure in said container through said aperture, said closure integrally connected to the edge of said area through a hinged connection, said closure being larger than said aperture to provide an area of sealing overlap, said closure member raised above the surrounding marginal portion of said opening a given amount, and the size of said opening and said given amount of raising of the closure member cooperating to limit the deflection of said closure member when a digitally applied push-in force is applied to an angle which is less than the angle at which the elastic limit of the metal of said hinge connection is exceeded, to thereby avoid permanent deflection of said closure member into said container upon the application of said digitally applied push-in force to said closure member.

7. Container member of claim 6, wherein said angle is less than 7.5°.

8. A can end having a pressure-releasing closure of the push-in type formed therein by severance, said closure having an integral connection of metal to said can end, said closure being configured such that a digit cannot totally engage said closure, sealant on the inner side of said can end at least in the area wherein said can end is severed to form said closure to seal the severed area against loss of can contents, a raised portion on the closure projecting above the surrounding surface of the can end sufficient to be digitally engagable to depress said closure an amount sufficient to break the sealant seal to thereby vent the can contents, the said surrounding surface of the can end being digitally engagable upon further depression of said closure to thereby limit additional depression of said closure into said can such as to prevent the elastic limit of said connection from being exceeded, whereby the closure is repeatedly openable and closable.

* * * * *